US007658050B2

(12) United States Patent
Bouchard et al.

(10) Patent No.: US 7,658,050 B2
(45) **Date of Patent: *Feb. 9, 2010**

(54) ARTIFICIAL MASONRY UNIT, A MASONRY WALL, A KIT AND A METHOD FOR FORMING A MASONRY WALL

(75) Inventors: Michel Bouchard, Montreal (CA); Andre Ouellet, Magog (CA)

(73) Assignee: Les Materiaux de Construction Oldcastle Canada Inc., Saint-John (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/733,346

(22) Filed: Apr. 10, 2007

(65) Prior Publication Data

US 2007/0193176 A1 Aug. 23, 2007

Related U.S. Application Data

(62) Division of application No. 10/441,239, filed on May 19, 2003, now abandoned.

(51) Int. Cl.
*E04B 1/00* (2006.01)
*E04G 21/00* (2006.01)
*E04G 23/00* (2006.01)

(52) U.S. Cl. ..... 52/745.06; 52/749.11; 52/387

(58) Field of Classification Search ..... 52/385, 52/387, 434, 562, 506.08, 384, 386, 591.4, 52/609, 314, 311.2, 391, 482; 249/96, 15, 249/141

See application file for complete search history.

(56) References Cited

U.S. PATENT DOCUMENTS 147,061 A 2/1874 Manvel (Continued)

FOREIGN PATENT DOCUMENTS

BE 742832 5/1970

(Continued)

OTHER PUBLICATIONS

"U.S. Appl. No. 11/379,462 Non-final Office Action", Mar. 19, 2009.

*Primary Examiner*—Richard E Chilcot, Jr.
*Assistant Examiner*—Chi Q Nguyen
(74) *Attorney, Agent, or Firm*—Kilpatrick Stockton LLP; Camilla C. Williams; Tiffany L. Williams

(57) ABSTRACT

An artificial masonry unit suitable for use with a panel made of a compressible material having masonry unit receiving depressions in a front face thereof and protruding ribs defining and bordering the depressions. The depressions are sized to receive respective artificial masonry units in a close-fitting relationship. The artificial masonry unit comprises a body bounded by a front face, a back face, and a lateral face providing a thickness to the unit, and a back peripheral edge joining the back face and the lateral face. A tooth projection is projecting from the lateral face next to and parallel to the back peripheral edge for thrusting into the protruding rib when the masonry unit is inserted in a respective depression. Thanks to the tooth projection that is thrusting into the rib of a respective depression and that helps retaining the masonry unit within the depression prior to mortaring the wall, there is no need for using a mixture of cement to temporarily retain the masonry units within the depression. A method and a kit for making a masonry wall with the above described masonry unit is also disclosed.

15 Claims, 12 Drawing Sheets

U.S. PATENT DOCUMENTS 479,442 A 7/1892 Marvick
D27,761 S 10/1897 Mark
748,141 A 12/1903 Zwerk
803,014 A 10/1905 McIlravy
1,796,631 A 3/1931 Stryker
2,148,167 A 2/1939 Lyman
2,231,006 A 2/1941 Harshberger
2,231,008 A 2/1941 Ochs
2,241,603 A 5/1941 Kirschbraun
2,339,489 A 1/1944 Kublanow
2,510,416 A 6/1950 Pretty
2,573,482 A 10/1951 Peik
2,624,298 A 1/1953 Farren
2,924,963 A * 2/1960 Taylor et al. ..... 52/509
2,938,376 A 5/1960 Workman et al.
2,938,378 A 5/1960 Workman et al.
2,964,800 A 12/1960 Dorsett
3,095,671 A 7/1963 Fink et al.
3,231,646 A * 1/1966 Conder et al. ..... 264/86
3,238,589 A 3/1966 McClarney
3,267,823 A 8/1966 MacRae
3,350,827 A 11/1967 Sugar
3,380,215 A 4/1968 Schaefer et al.
3,435,577 A 4/1969 O'Leary
3,440,777 A 4/1969 Martin
3,484,514 A 12/1969 Longinotti
3,496,694 A 2/1970 Hicks et al.
3,521,418 A 7/1970 Bartoloni
3,602,476 A * 8/1971 Iragorri ..... 249/96
3,605,369 A 9/1971 Merrill et al.
3,712,825 A 1/1973 Yocum
3,868,801 A 3/1975 Weiner
3,870,423 A 3/1975 Peitz
3,873,225 A 3/1975 Jakobsen et al.
3,884,737 A 5/1975 Bransford, Jr.
3,908,326 A 9/1975 Francis
3,947,192 A 3/1976 Rosenberger
4,044,520 A 8/1977 Barrows
4,065,899 A 1/1978 Kirkhuff
4,185,939 A 1/1980 Barth et al.
4,279,106 A 7/1981 Gleason et al.
4,335,549 A 6/1982 Dean, Jr.
4,399,643 A 8/1983 Hafner
4,432,183 A 2/1984 Pike et al.
4,433,518 A 2/1984 Rice
4,492,065 A 1/1985 Clarke, Jr. et al.
4,506,483 A 3/1985 Phalen, Jr.
4,510,729 A 4/1985 Syring
D278,935 S 5/1985 Scheiwiller
4,535,579 A 8/1985 Burgoyne et al.
D282,288 S 1/1986 Bates
4,574,536 A 3/1986 Bamber et al.
D283,551 S 4/1986 Repasky
4,589,241 A 5/1986 Volpenhein
4,656,722 A 4/1987 Armstrong
4,731,969 A 3/1988 Baker et al.
4,738,068 A 4/1988 Mendez
4,752,520 A 6/1988 Franklin
4,761,095 A 8/1988 Bartlechner
4,788,808 A 12/1988 Slocum
4,858,410 A 8/1989 Goldman
4,869,660 A 9/1989 Ruckstuhl
4,899,514 A 2/1990 Brookhart, Jr.
4,956,949 A 9/1990 Francis
4,987,712 A * 1/1991 Mancuso ..... 52/387
5,009,387 A 4/1991 Scott et al.
5,060,444 A 10/1991 Paquette
5,078,940 A 1/1992 Sayles
5,173,233 A 12/1992 Kafarowski
5,217,630 A 6/1993 Sayles
5,228,937 A 7/1993 Passeno
5,232,608 A 8/1993 Mayer
5,232,646 A 8/1993 Nasvik et al.
5,268,137 A 12/1993 Scott et al.
5,286,139 A 2/1994 Hair
5,342,142 A 8/1994 Barth et al.
5,348,417 A 9/1994 Scheiwiller
5,386,963 A 2/1995 Nasvik et al.
5,459,938 A 10/1995 Knight et al.
5,501,049 A 3/1996 Francis et al.
5,502,940 A 4/1996 Fifield
5,526,630 A * 6/1996 Francis et al. ..... 52/745.19
RE35,380 E 11/1996 Rea et al.
5,570,551 A 11/1996 Koc, Sr. et al.
D378,702 S 4/1997 Blomquist et al.
5,625,990 A 5/1997 Hazlett
5,632,922 A 5/1997 Nasvik et al.
5,686,009 A 11/1997 Gregersen
5,713,155 A 2/1998 Prestele
D393,727 S 4/1998 Wiegand, Jr.
5,836,572 A 11/1998 Sugiyama
5,839,251 A 11/1998 Weinstein
5,855,075 A 1/1999 DiGiovanni
5,894,676 A 4/1999 DiGiovanni
5,921,705 A 7/1999 Hodson et al.
6,041,567 A 3/2000 Passeno
6,082,933 A 7/2000 Maguire et al.
6,098,363 A * 8/2000 Yaguchi ..... 52/385
D431,870 S 10/2000 Ziegler, Jr.
D431,871 S 10/2000 Abbrancati
6,159,401 A 12/2000 Hoesch
6,164,037 A 12/2000 Passeno
D439,677 S 3/2001 Mattox
6,209,848 B1 4/2001 Bolles et al.
6,355,193 B1 3/2002 Stott
6,360,505 B1 3/2002 Johns
6,431,798 B1 8/2002 Magliocco
6,443,663 B1 9/2002 Scales et al.
D477,091 S 7/2003 Manthei
D479,341 S 9/2003 Scullion et al.
6,616,874 B1 9/2003 Lazar
6,634,617 B2 10/2003 Potvin
D488,568 S 4/2004 MacDonald
D491,675 S 6/2004 Ogawa et al.
6,780,369 B1 8/2004 Darrow et al.
6,857,248 B2 * 2/2005 Ouellet et al. ..... 52/745.06
6,871,468 B2 3/2005 Whitson
D505,733 S 5/2005 Castonguay et al.
6,990,778 B2 * 1/2006 Passeno ..... 52/385
D539,927 S 4/2007 Whitson
D540,954 S 4/2007 Bouchard
7,267,321 B1 9/2007 Morrell
D552,258 S 10/2007 Strand et al.
D555,810 S 11/2007 Strand
D557,428 S 12/2007 Doman
D578,224 S 10/2008 Lacas
D579,576 S 10/2008 Lacas
2003/0126821 A1 7/2003 Scherer et al.
2003/0164574 A1 9/2003 Hammer et al.
2003/0182011 A1 9/2003 Scherer
2004/0091317 A1 5/2004 Shouldice
2004/0098938 A1 5/2004 Nordstrand
2004/0104511 A1 6/2004 Griffith
2004/0191461 A1 9/2004 Riccobene
2005/0028476 A1 2/2005 Bouchard et al.
2006/0249881 A1 11/2006 Castonguay et al.

FOREIGN PATENT DOCUMENTS

CA 0909538 9/1972
DE 93888 12/1896
DE 3733707 4/1989
DE 10050908 4/2002
EP 0088193 9/1983

| | | | |
|---|---|---|---|
| EP | 0088198 | | 9/1983 |
| EP | 0095420 | | 11/1983 |
| EP | 0115374 | | 8/1984 |
| EP | 0175500 | | 3/1986 |
| EP | 0236585 | | 9/1987 |
| EP | 0262712 | A2 | 4/1988 |
| EP | 0375802 | | 7/1990 |
| FR | 1259641 | | 4/1961 |
| FR | 095420 | | 11/1970 |
| FR | 2583808 | | 12/1986 |
| GB | 416649 | | 9/1934 |
| GB | 483969 | | 4/1938 |
| GB | 896450 | | 5/1962 |
| GB | 995692 | | 6/1965 |
| GB | 1020013 | | 2/1966 |
| GB | 2046808 | | 11/1980 |
| GB | 1586369 | | 3/1981 |
| GB | 2111550 | | 7/1983 |
| GB | 2123058 | | 1/1984 |
| GB | 2178773 | | 2/1987 |
| GB | 2245613 | | 1/1992 |
| GB | 2280690 | A | 2/1995 |
| JP | 04070305 | | 3/1992 |
| JP | 06071630 | | 3/1994 |
| JP | 2002/285504 | | 10/2002 |
| WO | WO-8807920 | | 10/1988 |
| WO | WO8906728 | | 7/1989 |
| WO | WO-9322527 | | 11/1993 |

* cited by examiner

ARTIFICIAL MASONRY UNIT, A MASONRY WALL, A KIT AND A METHOD FOR FORMING A MASONRY WALL

CROSS-REFERENCE TO RELATED APPLICATIONS

This is a division of U.S. patent application Ser. No. 10/441,239 filed on May 19, 2003, now pending, which claims priority to Canadian Patent Application No. 2387181 filed May 22, 2002, both of which are incorporated in full by reference.

FIELD OF THE INVENTION

The present invention relates to the field of masonry works and installations. More particularly, it concerns an artificial masonry unit suitable for use with a panel having depressions adapted to receive masonry units so as to form a masonry wall with a predetermined pattern of stonework or brickwork.

PRIOR ART

Already known in the prior art, there is the panel system disclosed in the prior PCT application PCT/CA02/00748 in the name of the Applicant, which system makes it possible to easily and rapidly make an artificial masonry wall that looks like a conventional and natural masonry wall. For that, the system makes use of panels similar to the ones shown in FIG. 1. These panels (1), which are typically made of foam, comprise, in a front face thereof, masonry unit receiving depressions (2) and protruding ribs (4) defining and bordering the depressions (2), which are sized to receive respective artificial masonry units (5) in a close-fitting relationship. Usually, when a masonry wall is made using such panels (1), a mixture of adhesive cement is applied into each depression (2) prior to the insertion of masonry units (5) therein. When a masonry unit has been inserted in each of the depressions (2), the masonry units (5) are mortared together, using any type of mortar known in the art. The mixture of adhesive helps retaining the masonry units into the depressions until the whole structure is mortared.

As can be easily understood, the use of such mixture of cement to temporarily retain the masonry units is time consuming, unhandy and messy.

The following prior art documents provide other examples of wall construction using panels and/or masonry units: U.S. Pat. Nos. 2,339,489; 3,238,589; 3,350,827; 3,435,577; 3,496,694; 3,521,418; 3,712,825; 3,884,737; 3,908,326; 4,433,518; 4,510,729; 4,589,241; 4,656,722; 4,858,410; 5,009,387; 5,228,937; 5,232,608; 5,232,646; 5,232,646 (re-examined); 5,386,963; 5,459,938; 5,501,049; 5,570,551; 5,632,922; 5,836,572; 5,839,251; 5,855,075; 5,894,676; 6,041,567; 6,164,037; and RE 35,380.

SUMMARY OF THE INVENTION

In order to overcome that drawback, the present invention provides an artificial masonry unit suitable for use with a panel, preferably made of a compressible material. The panel has masonry unit receiving depressions in a front face thereof and protruding ribs defining and bordering the depressions which are sized to receive respective artificial masonry units in a close-fitting relationship. Each of the artificial masonry units comprises a body bounded by a front face, a back face, and a lateral face providing a thickness to the unit. The unit further comprises a back peripheral edge joining the back face and the lateral face, and a tooth projection projecting from the lateral face next to and parallel to the back peripheral edge for thrusting into the protruding rib when the masonry unit is inserted in a respective depression.

Thanks to the tooth projection that is thrusting into the rib of a respective depression and that helps retaining the masonry unit within the depression prior to mortaring the wall, there is no more need for using a mixture of cement to temporarily retain the masonry units within the depression. A masonry unit according to the invention thus helps a professional, and also unskilled persons, to even more easily and rapidly construct a masonry work having the look of a traditional masonry work made by highly skilled artisans.

According to another aspect, the present invention also provides a masonry wall covering a building surface and comprising a plurality of panels mounted side by side on the building surface. Each one of the panels comprises a back face covering the building surface, and a front face with a plurality of depressions defined and bordered by protruding ribs. The depressions are shaped and sized to receive respective artificial masonry units. The masonry wall further comprises a plurality of artificial masonry units as defined above inserted into the depressions, and a mortar material binding the masonry units together.

Preferably, the masonry wall comprises a plurality of wall-ties for securing the masonry wall to the building surface. Each of the wall-ties consists of a generally L-shaped bracket mounted in a corner of a respective one of the depressions of the panel between the masonry unit inserted therein and the respective depression, the corner being defined by a bottom face and the rib of the depression. The L-shaped bracket comprises a first flange screwed to both the bottom face of the depression and the building surface; and a second flange extending at right angle to the first flange along the rib. The second flange has an end projecting out of the depression. This end is embedded in the mortar material.

According to further aspects, the present invention provides a kit and a method for making a masonry wall as defined above.

The kit comprises:

- a set of panels to be mounted side by side on the building surface, each one of the panels comprising:
  - a back face for covering the building surface; and
  - a front face with a plurality of depressions defined and bordered by protruding ribs, the depressions being shaped and sized to receive respective artificial masonry units;
- a set of artificial masonry units as defined above to be inserted and retained into said depressions; and
- mortar material for binding the masonry units together.

In accordance with a preferred aspect of the invention, the kit further comprises a set of wall-ties as defined above, for securing the masonry wall to the building surface.

The method for making a masonry wall according to the present invention comprises the steps of:

a) mounting side by side, on a building surface, a plurality of panels as defined above;

b) providing a set of artificial masonry units as defined above;

c) inserting, in each of the depressions, one of the artificial masonry units and retaining the unit by thrusting the tooth projection into the adjacent protruding rib of the respective depression; and d) mortaring the masonry units.

Preferably, the method comprises, before step c), the steps of tying the masonry wall to the building surface, which comprises the steps of:

mounting, in a corner of a plurality of the depressions, a generally L-shaped bracket as defined above; and screwing the brackets to both the panel and the building surface.

BRIEF DESCRIPTION OF THE DRAWINGS

Other objects and advantages of the invention will become apparent upon reading the detailed description and upon referring to the drawings in which.

LIST OF THE NUMERAL REFERENCES

Figure 1:
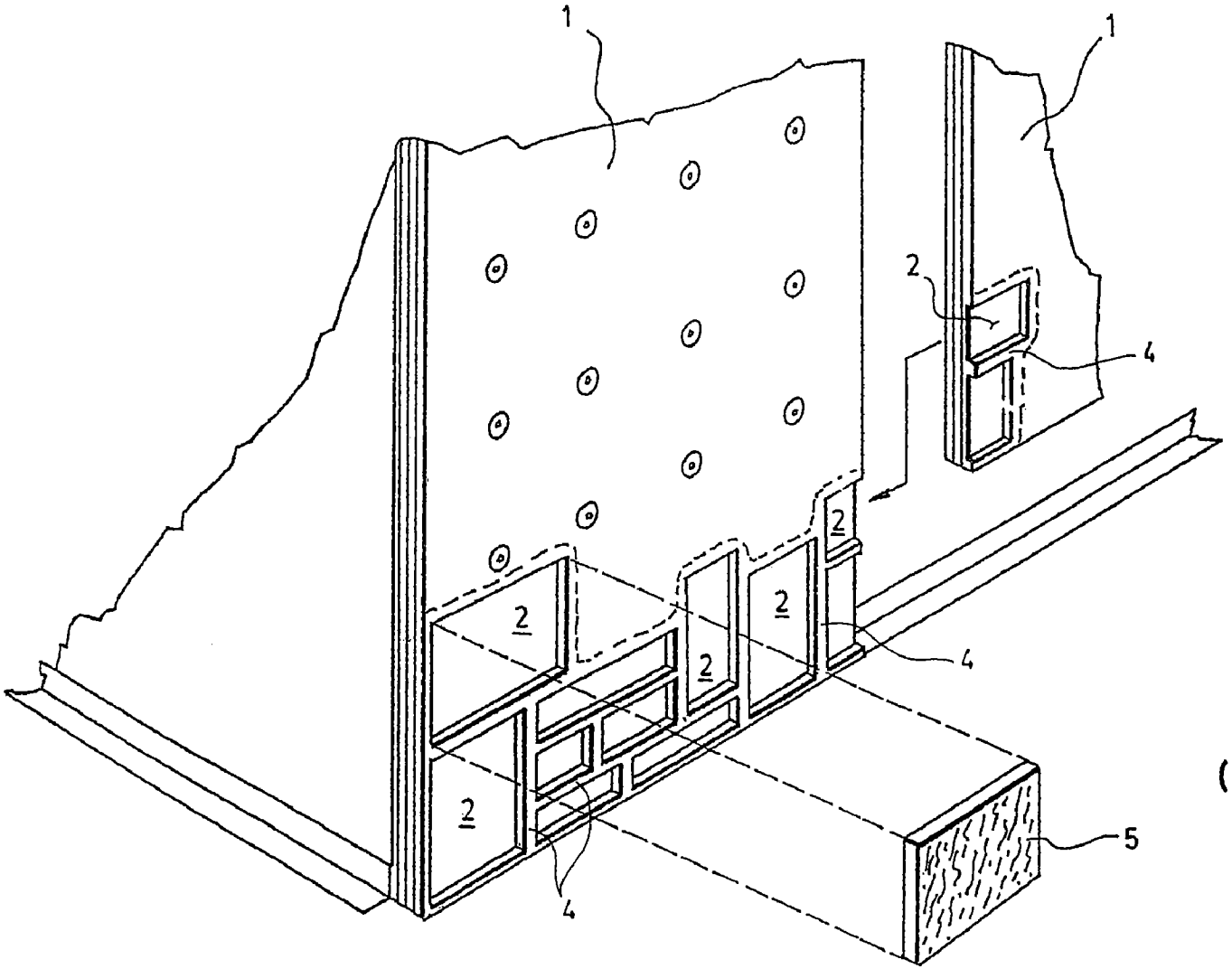
FIG. 1 ( PRIOR ART )
FIG. 1 is a perspective view showing a section of a wall where a first panel is installed, and where a second panel and an artificial masonry unit as in the prior art are about to be installed.

1 panel
2 masonry unit receiving depressions
4 ribs
5 prior art masonry units
6 corner of depression
7 back face of panel
8 bottom face of depression
9 front face of panel
10 masonry unit according to the invention
11 body of the unit
12 front face
13 backface
14 back peripheral edge
15 top face
17 bottom face
19 side faces
20 tooth projection
22 reinforcing structure
23 groove
30 compressible projections of the panel
40 masonry wall
42 building surface
43 mortar material
44 wall-ties (also referred as L-shaped brackets)
46 first flange of the bracket
47 screw receiving hole
48 second flange of the bracket
49 screw
50 end of the second flange (also referred to as the extension)
52 hooks on the bracket
54 accessory bracket
56 front face of bracket
57 back face of bracket
58 hook of the accessory bracket
60 ledge of bracket

DESCRIPTION OF PREFERRED EMBODIMENTS

In the following description, similar features in the drawings have been given similar reference numerals and in order to lighten the figures, some elements are not referred to in some figures if they were already identified in a previous figure.

Figure 2:
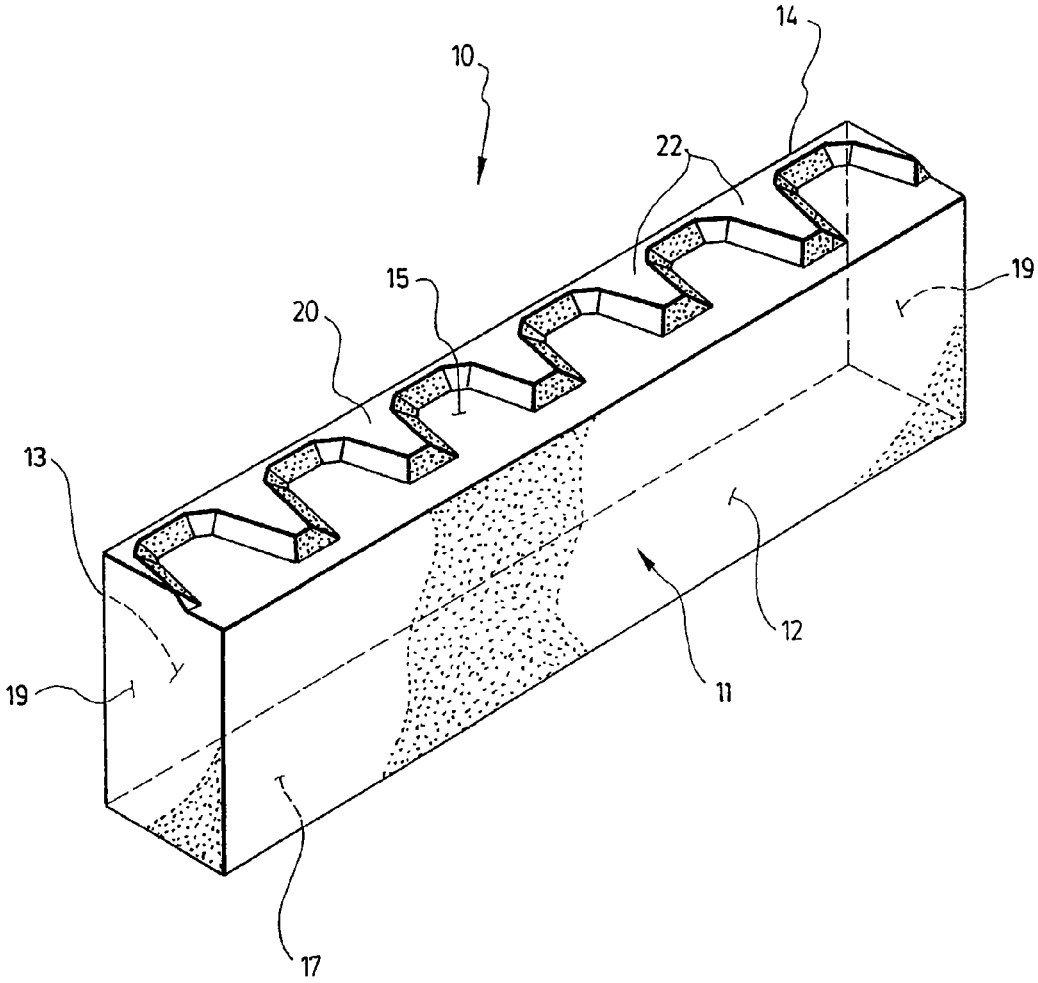
FIG. 2 is a perspective view of an artificial masonry unit according to a first preferred embodiment of the invention, viewed from the front.
Figure 3:
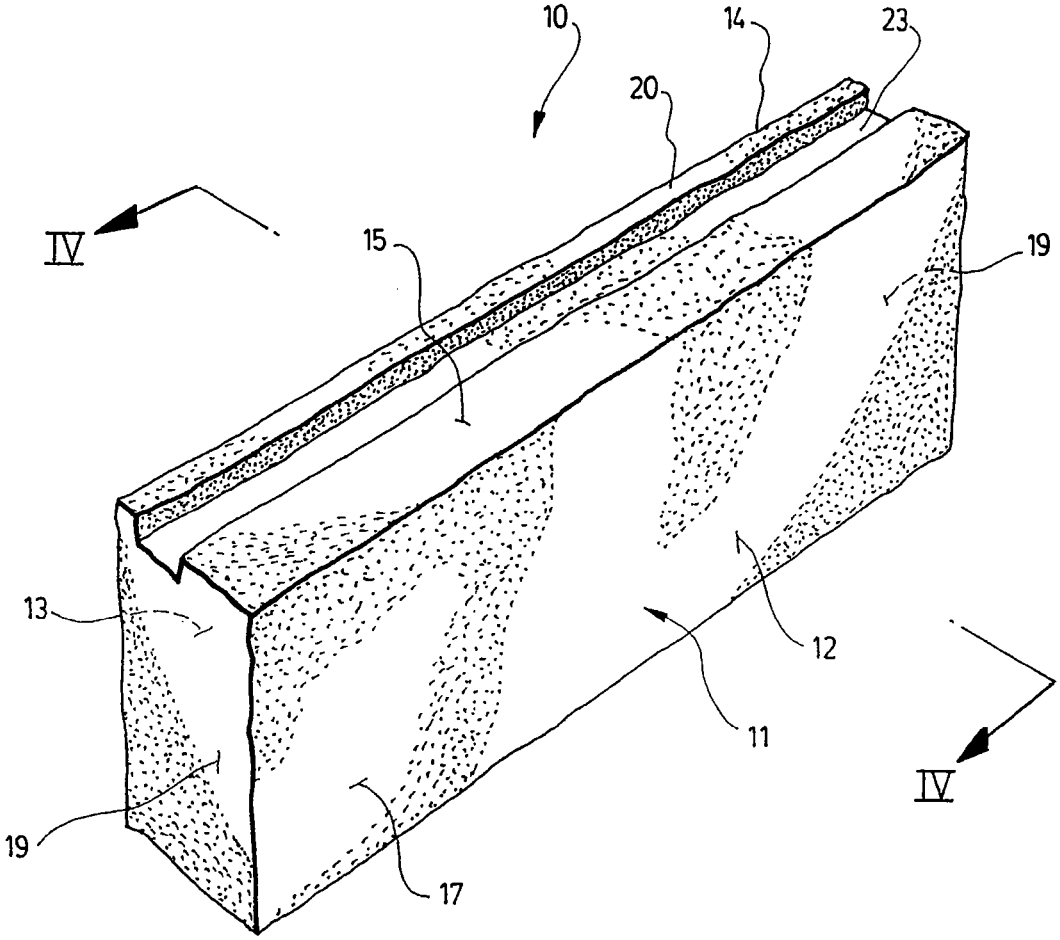
FIG. 3 is a perspective view of an artificial masonry unit according to a second preferred embodiment of the invention, viewed from the front.
Figure 13:
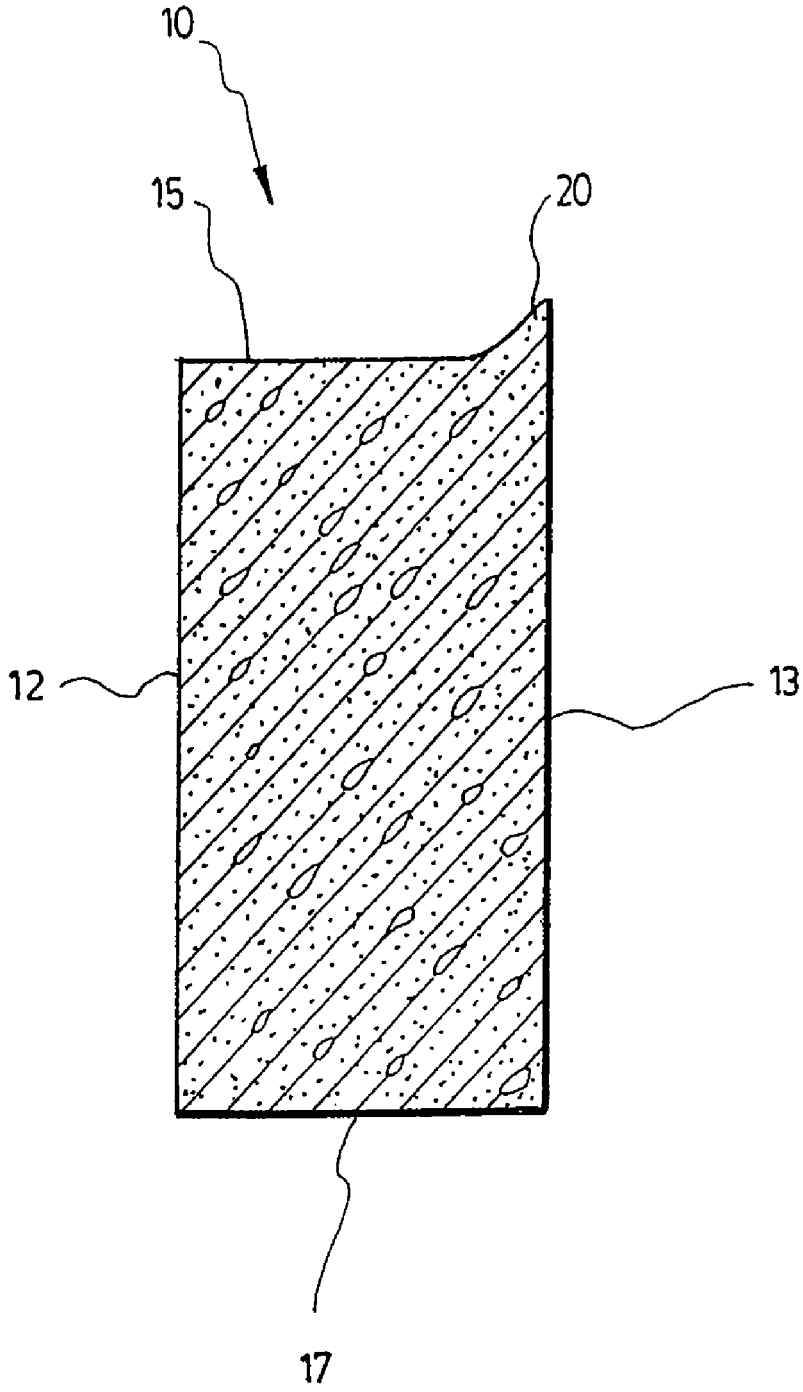
FIG. 13 is a cross section view of a masonry unit of another preferred embodiment of the invention.

Referring to either one of FIGS. 2, 3 or 13, an artificial masonry unit (10) according to the invention comprises a body (11) with a front face (12), a back face (13) and a lateral face which divides into four edge faces including a top face (15), a bottom face (17), and two opposite side faces (19). The front face (12) is the face that is still visible to people once the artificial masonry unit (10) has been inserted in a masonry unit receiving depression (2) of a panel (1). The masonry unit (10) is characterized in that it further comprises a tooth projection (20) projecting from the lateral face next to and parallel to the back peripheral edge (14) for thrusting into the protruding rib (4) of the depression (2) when the masonry unit (10) is inserted in a respective depression (2)

Figure 8A:
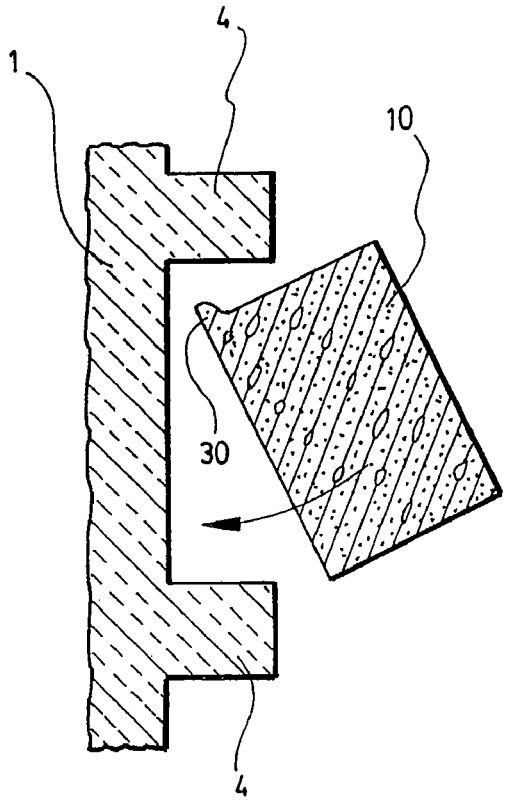
FIGS. 8*a* and 8*b* are cross section views of an artificial masonry unit according to the invention being inserted in a depression of either one of the panels of FIGS. 5 and 6 and showing in FIG. 8*b*) the projecting tooth of the unit thrusting into the rib of the depression.
Figure 8B:
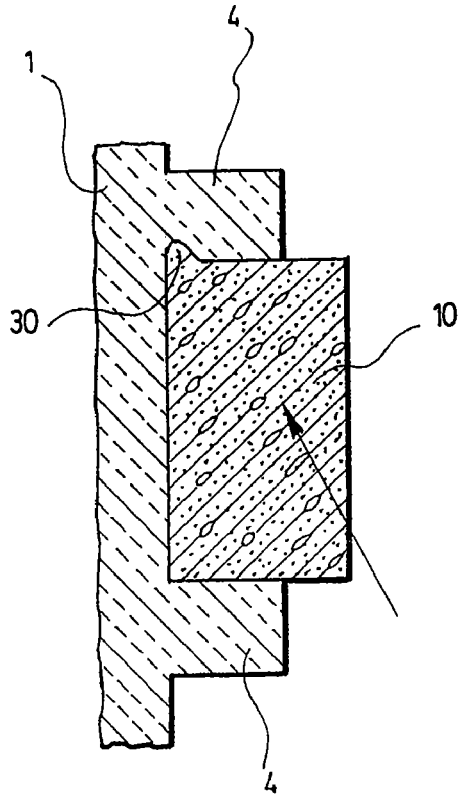

As best shown in FIG. 8, the tooth projection (20) thrusts into the rib (4) of the depression (2), and thereby helps retaining the masonry unit (10) within the depression (2) prior to mortaring the whole structure. There is no more need for using a mixture of cement to temporarily retain the masonry units (10) within the depression (2).

The tooth projection (20) is preferably a ridge-shaped projection spanning the top face (15) of the unit (10). More preferably, the tooth projection (20) is projecting from the back edge (14) of the unit (10).

In accordance with the first preferred embodiment shown in FIG. 2, the masonry unit (10) comprises a series of spaced reinforcing structures (22) along the tooth projection (20) to prevent the same from being chipped off, as for example, during handling and shipping. Preferably, each of the reinforcing structures (22) has the shape of a sloping projection. This first preferred embodiment, with its natural stone look, is preferably used with the panel (1) of FIG. 5, which is adapted to build a stonework.

Figure 4:
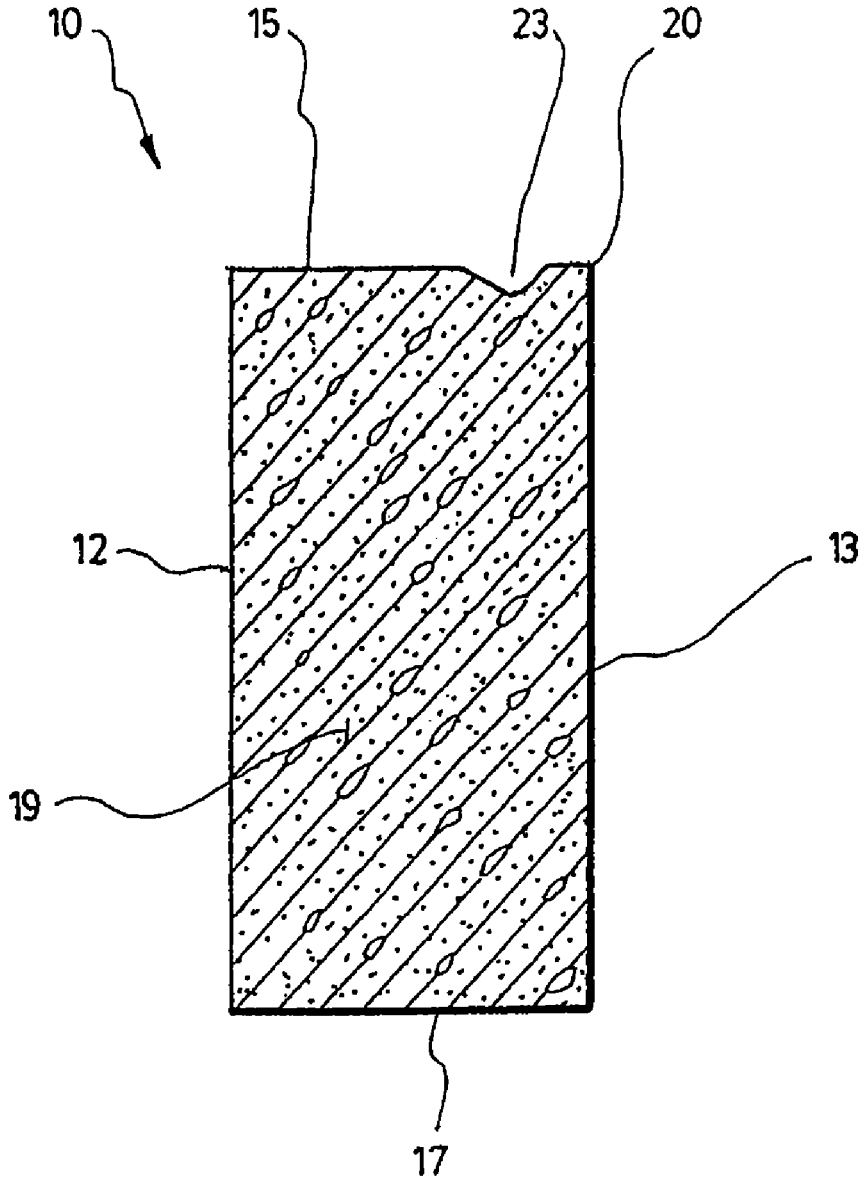
FIG. 4 is a cross section view of the masonry unit of FIG. 3 along line IV-IV.

In accordance with the second preferred embodiment shown in FIGS. 3 and 4, a groove (23) is extending along the tooth projection (20). This preferred embodiment, with its brick look, is preferably used with the panel (1) of FIG. 6, which is adapted to build a brickwork.

As shown in either one of FIGS. 2, 3 or 13, the tooth projection (20) is preferably projecting from the top face (15) of the unit (10). It is however worth mentioning that in another embodiment of the invention, not illustrated, it may project from the side faces (19) or from both the top face (15) and the side faces (19), as long as it is adapted to retain the masonry unit (10) and prevent the same from falling out of the depression (2).

Figure 5:
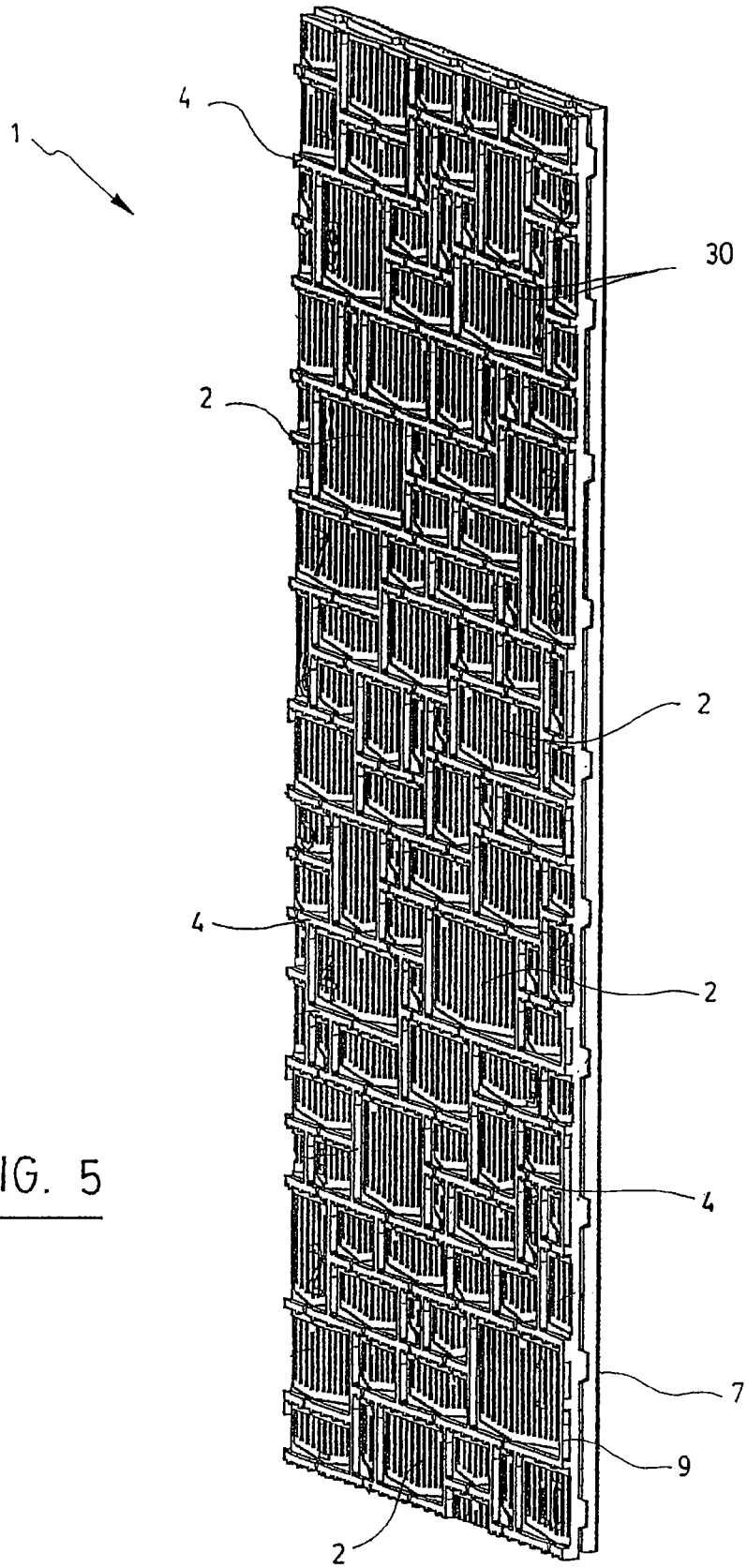
FIG. 5 is a perspective view of a first variant of a panel having a plurality of depressions adapted to receive masonry units according to the invention.
Figure 6:
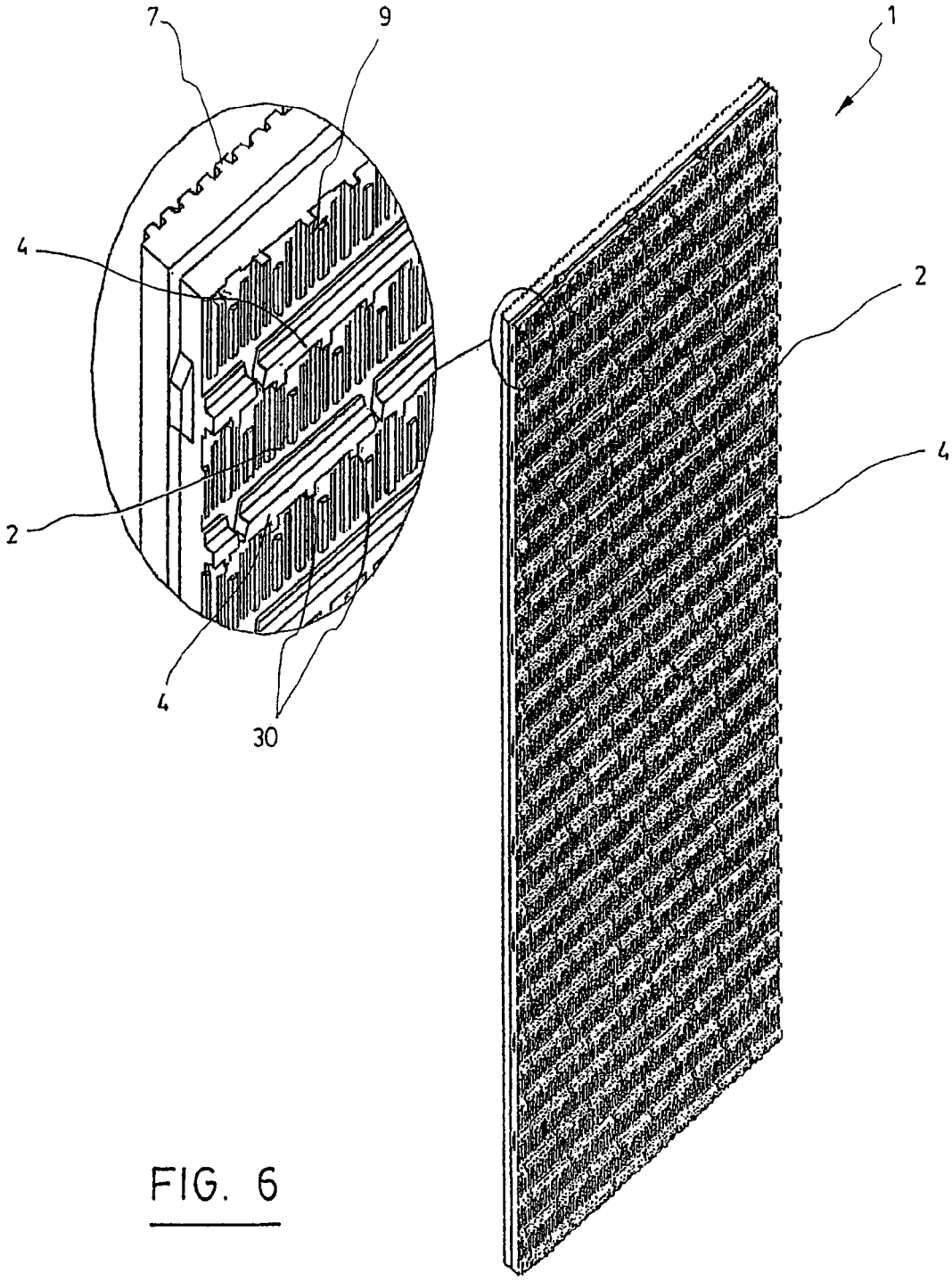
FIG. 6 is perspective view of a second variant of a panel having a plurality of depressions adapted to receive masonry units according to the invention.

Panels (1) suitable for use with masonry units (10) according to the invention are illustrated in FIGS. 5 and 6. The panel (1) shown in FIG. 5 is used for making a stonework and the panel (1) of FIG. 6 is used for making a brickwork. Each of these panels (1) has a front face (9) with masonry unit receiving depressions (2) each adapted to receive a respective masonry unit (10). These panels (1) are preferably made of foam, or any compressible material. The foam preferably used has no memory, meaning that once it has been compressed, it does not regain its original shape. The tooth projection (20) provided on the lateral face (15, 19) of the unit is thus important to retain the unit within the depression. Because the foam has no memory, a simple angled lateral face would not be suitable for retaining the unit (10) in a respective depression (2).

Referring to FIG. 5, a predetermined pattern of depressions (2) is cut in the front face (9) of the panel (1) in a staggered fashion, to provide a masonry wall that looks like a stonework, whereas the depressions (2) of the panel (1) shown in FIG. 6 are linear, so as to provide a masonry wall that looks like a brickwork.

Preferably, the depressions (2) are pre-cut in the panel (1), or pre-moulded, as the panel (1) is being moulded. They are shaped to fit artificial masonry units (10) as described above, either bricks or pre-cast concrete simile-stones or masonry pieces made of plastic. The depressions (2) may have a symmetrical shape, for example rectangular, or an irregular shape to fit the natural curved outline of a stone. More preferably, the masonry units are pre-cast concrete simile-stones having predetermined shapes and sizes.

Figure 7:
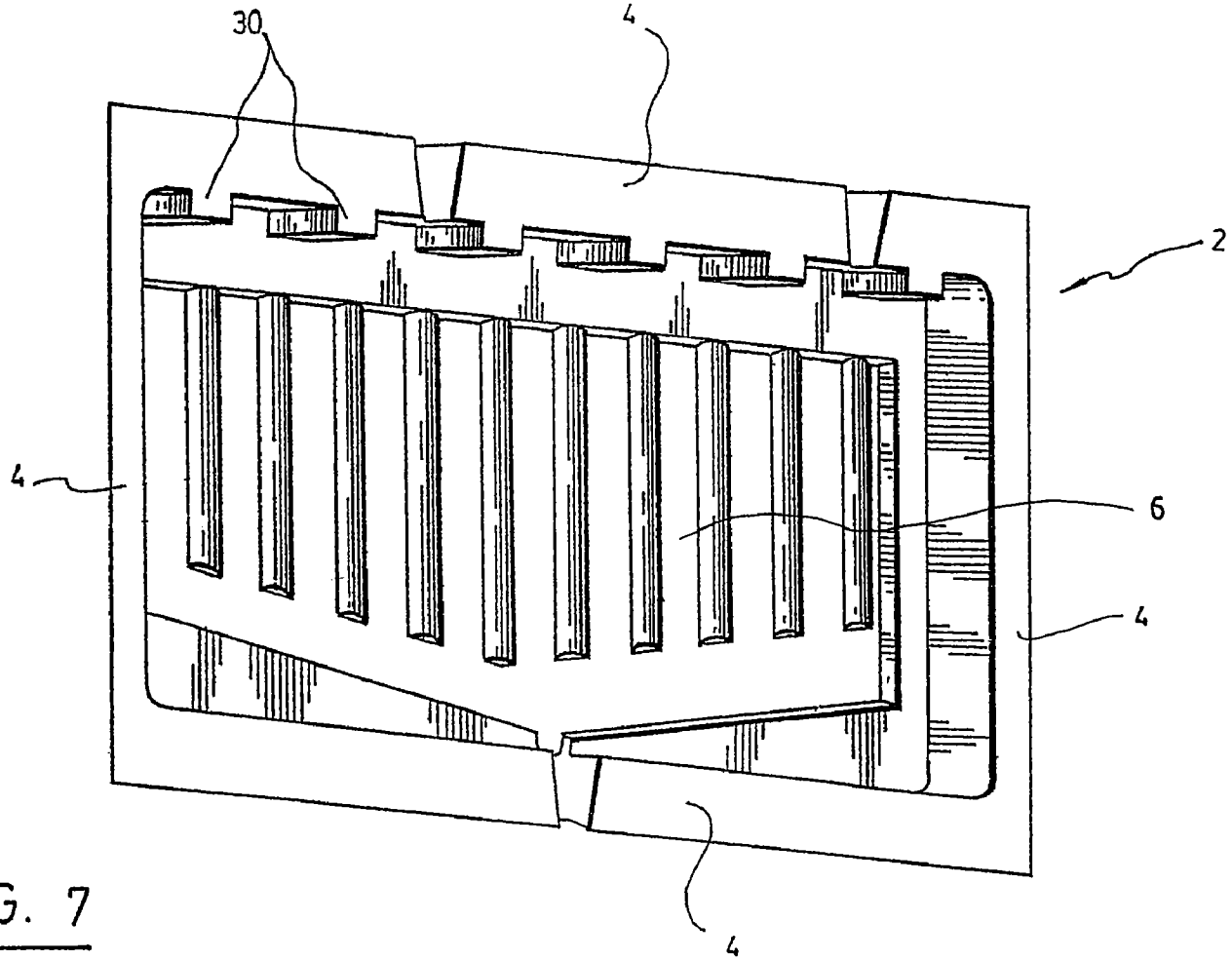
FIG. 7 is a perspective view of one of the depressions of the panel shown in FIG. 5.

In accordance with a preferred aspect, best shown in FIGS. 5, 6 and 7, the panel (1) comprises a series of compressible projections (30) made of a resilient material projecting from the ribs (4) outlining the depressions (2). The compressible projections (30) are adapted to cooperate with the tooth projections (20) provided on the masonry units (10) to temporarily retain these pieces (10) within the depressions (2) before they have been bound together with the mortar.

Referring to FIG. 7, the compressible projections (30) are preferably projecting from a top rib (4) of each depression (2).

Turning now to FIG. 8, when a masonry unit (10) is inserted into a depression (2), the side wall of the rib (4) or the above-defined optional compressible projections (30) of the panel (1), are compressed by the tooth projections (20) provided on the masonry unit (10). Furthermore, thanks to the fact that the tooth projection is located near and parallel to the back edge (14) of the unit (10), the unit (10) is held tight within each depression (2).

The compressible projections (30) of the panel (1) are formed during the cuffing or the moulding of the depressions (2), whereas the tooth projections (20) of the masonry unit (10) are preferably moulded with the same.

Figure 9:
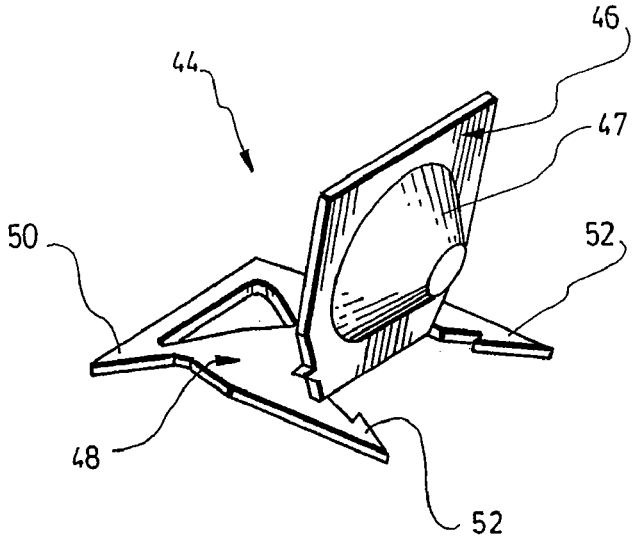
FIG. 9 is a perspective view of a wall-tie bracket used with a preferred embodiment of the invention for securing the masonry wall to the building surface.
Figure 10:
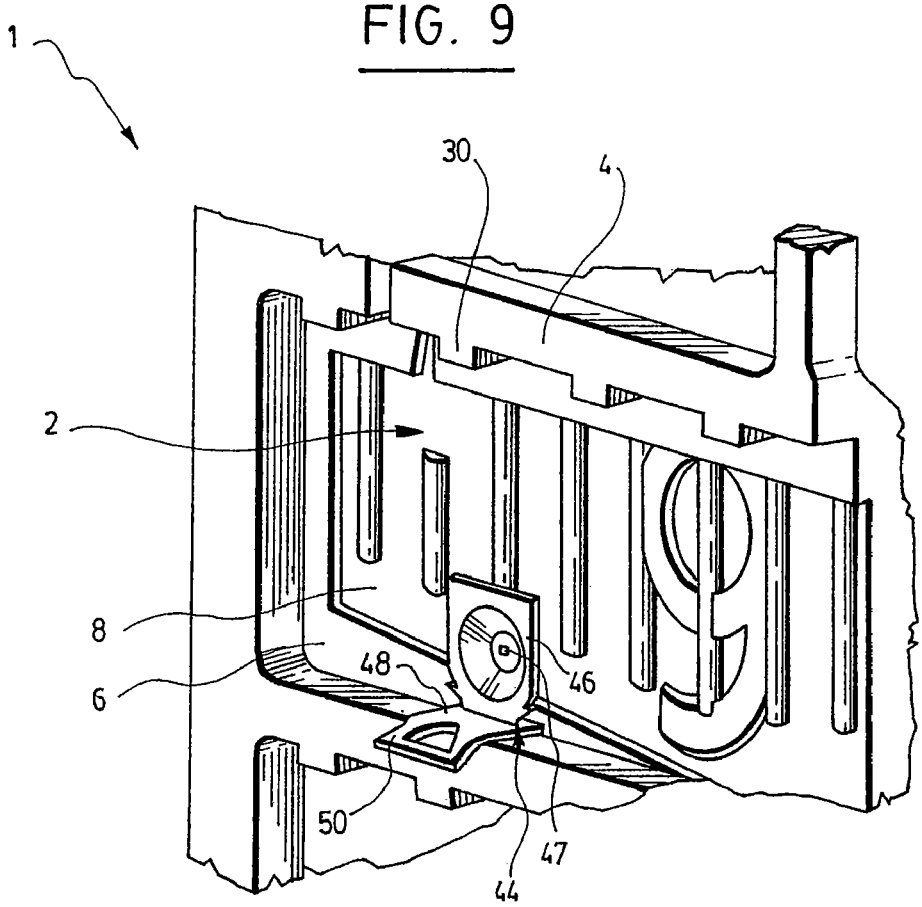
FIG. 10 is a partial perspective view of the panel shown in FIG. 5, showing the wall-tie bracket of FIG. 9 mounted in a corner of a depression.
Figure 11:
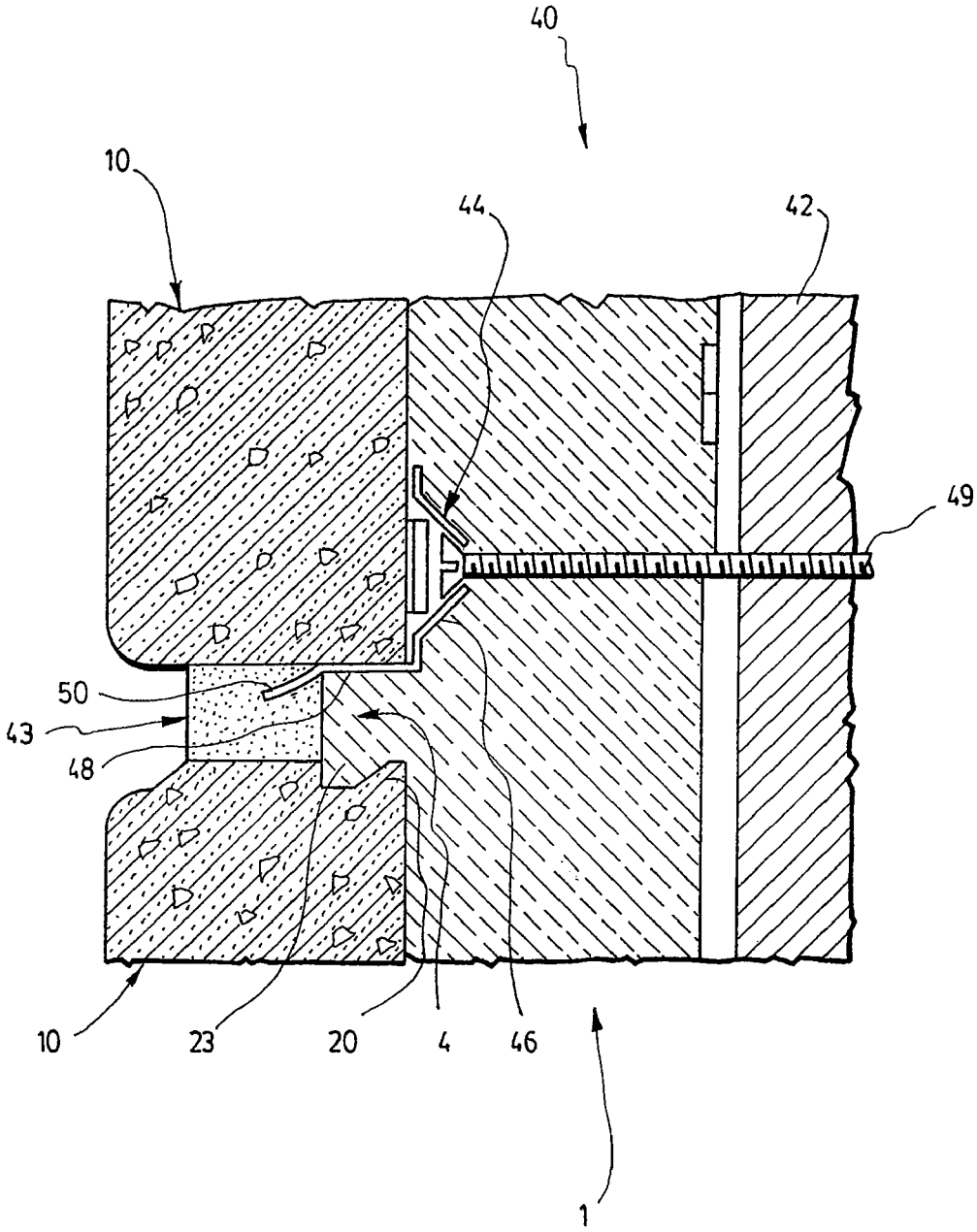
FIG. 11 is a cross section view of an artificial masonry unit as shown in FIG. 2 inserted in a depression of either one of the panels of FIGS. 5 and 6, showing how the masonry wall is secured to the building surface by means of the wall-tie bracket of FIG. 10.

Referring to FIG. 11, the masonry wall (40) according to the invention comprises masonry units (10) as described above inserted in the depressions (2) of the panels (1) described above mounted side by side on a building surface (42). The units (10) are mortared together by means of conventional mortar material (43). In accordance with a preferred embodiment, the wall (40) further comprises a plurality of wall-ties (44) for securing the masonry wall (40) to the building surface (42). Referring more particularly to FIGS. 9 and 10, each of the wall-ties (44) consists of a generally L-shaped bracket (44) mounted in a corner (6) of a respective one of the depressions (2) of the panel (1) between the masonry unit (10) inserted therein and the respective depression (2). The L-shaped bracket (44) comprises a first flange (46), provided with a screw receiving hole (47), screwed to the bottom face (8) of the depression (2) and the building surface (42), and a second flange (48) extending at right angle to the first flange (46) along the rib (4). The second flange (48) has an end (50), also referred herein as an extension, projecting out of the depression (2). This extension (50) is embedded in the mortar material (43).

Preferably, the bracket (44) further comprises at least one hook (52), more preferably two, which extends at right angle to the first flange (46) in a direction opposite to the second flange (48). Thanks to these hooks (52) which are insertable in the panel (1), it is possible to install at once all the brackets required, and then to install the masonry units (10) in the depressions (2).

Figure 12:
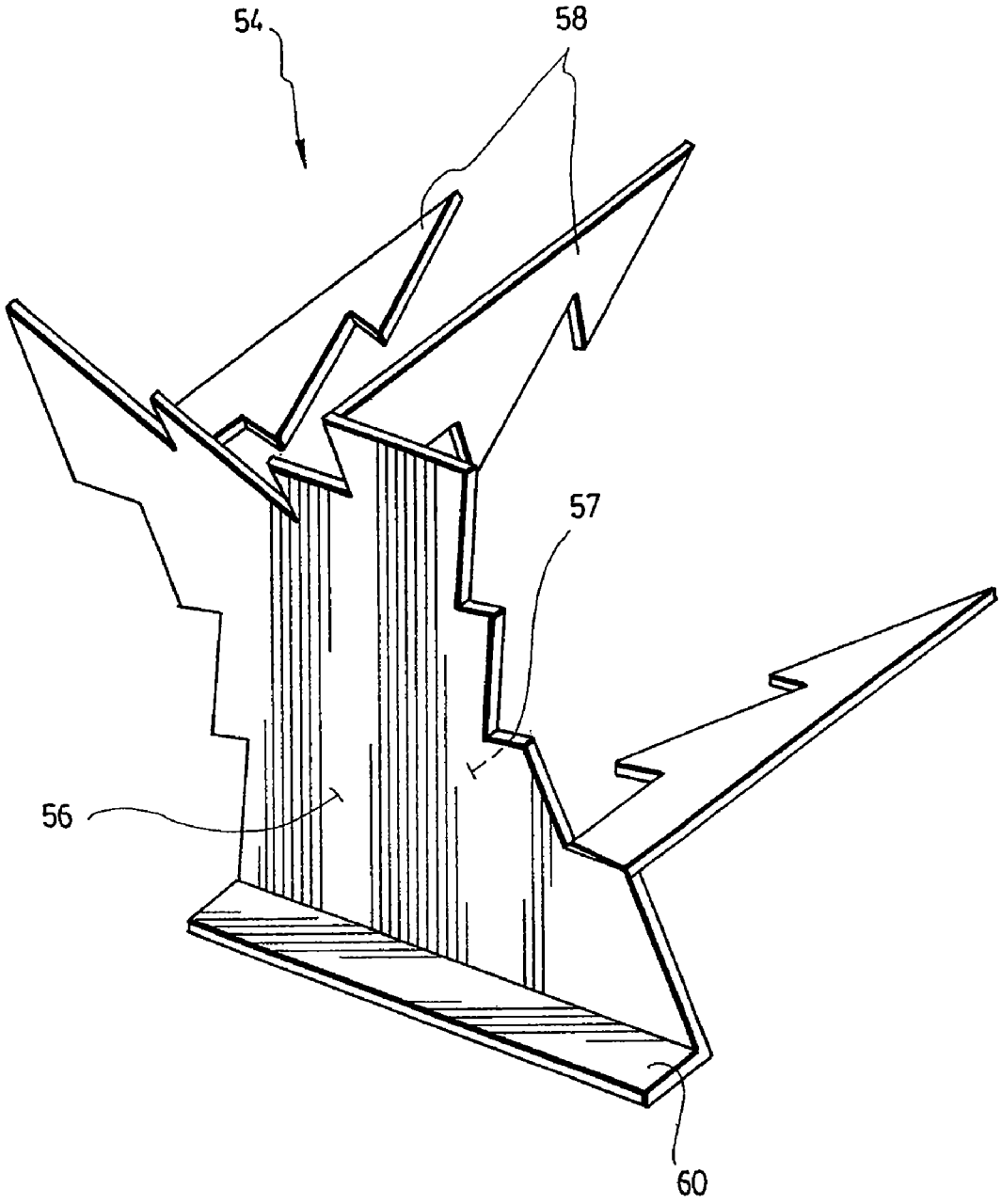
FIG. 12 is a perspective view of an accessory holding bracket that can be used with a panel system according to the invention.

Referring to FIG. 12, an accessory bracket (54) that can be used with the above system is illustrated. This bracket (54) which comprises hooks (58) projecting from a back face (57) thereof, and a front face (56) with a ledge (60), can be used to retain a masonry unit (10) on a planar surface of a panel (1) where there are no depressions (2). To this end, the front face (56) and the ledge (60) are covered with a bonding material such as glue. Thus, in order to install a masonry unit (10) on a planar foam panel (1), the accessory bracket (54) is hooked to the panel (1) and the masonry unit (10) is bonded to the front face (56) of the bracket (54).

The present invention also concerns a method for making a masonry wall (40) covering a building surface (42). The method comprises the steps of:

a) mounting side by side on the building surface (42) a plurality of panels (1), each one of the panels (1) having a front face (9) with a plurality of depressions (2) defined and bordered by protruding ribs (4), the depressions (2) being shaped and sized to receive respective artificial masonry units (10);

b) providing a set of artificial masonry units (10) as defined above;

c) inserting in each of the depressions (2) one of the artificial masonry unit (10) and securing the unit (10) by thrusting the tooth projection (20) into the adjacent protruding rib (4) of the respective depression (2); and d) mortaring the masonry units (10).

Preferably, the method further comprises, before step c), the step of tying the masonry wall (40) to the building surface (42). Referring to FIG. 10, this tying step comprises the steps of:

mounting, in a corner (6) of a plurality of the depressions (2), a generally L-shaped bracket (44), as described above and shown in FIG. 9; and screwing the brackets (44) to both the panel (1) and the building surface (42).

The present invention also concerns a kit for making a masonry wall (40) on a building surface (42), the kit comprising:

a set of panels (1) to be mounted side by side on the building surface (42), each one of the panels comprising:

a back face (7) for covering the building surface (42); and a front face (9) with a plurality of depressions (2) defined and bordered by protruding ribs (4), the depressions (2) being shaped and sized to receive respective artificial masonry units (10);

a set of artificial masonry units (10) as defined above to be inserted and retained into said depressions (2); and mortar material (43) for binding the masonry units (10) together.

Preferably, the kit further comprises a set of wall-ties (44) as defined above.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

As for example, the unit according to the invention may also be used with a stencil panel, that is to say a panel wherein the depressions are bottomless. In such a case the ribs defining the depressions comprise a groove matable with the tooth projection of the masonry unit.

What is claimed is:

1. A masonry wall covering a building surface, comprising:

a plurality of panels mounted side by side on the building surface, each panel comprising:

a back face covering the building surface; and a front face with a plurality of depressions defined and bordered by protruding ribs, said depressions being shaped and sized to receive respective artificial masonry units;

a plurality of artificial masonry units inserted into said depressions, each artificial masonry unit comprising:

a body bounded by a front face, a back face, and a lateral face that provides a thickness to the unit, and a back peripheral edge joining the back face and the lateral face, each of said masonry units further comprising:

a tooth projection projecting from the lateral face next to and parallel to the back peripheral edge, said tooth projection thrusting into an adjacent protruding rib of a respective one of said depressions; and mortar material binding the masonry units together.

2. The masonry wall as claimed in claim 1, comprising a plurality of wall-ties for securing the masonry wall to the building surface, each of said wall-ties consisting of a generally L-shaped bracket mounted in a corner of a respective one of said depressions of the panel between the masonry unit inserted therein and the respective depression, said corner being defined by a bottom face and the rib of the depression, said L-shaped bracket comprising:

a first flange screwed to the bottom face of the depression and the building surface; and a second flange extending at right angle to the first flange along the rib and having an end projecting out of the depression embedded in the mortar material.

3. The masonry wall as claimed in claim 2, wherein said bracket comprises:

at least one hook extending at right angle to the first flange in a direction opposite to the second flange, said hook being inserted in the panel.

4. The masonry wall as claimed in claim 1, wherein each of said panels comprises a series of compressible projections made of a resilient material projecting from the ribs outlining the depressions, said projections being compressed by the tooth projections provided on the masonry units.

5. The masonry wall as claimed in claim 4, wherein the compressible projections are projecting from a top rib of each of said depressions.

6. The masonry wall as claimed in claim 1, wherein each of said artificial masonry units has a rectangular shape and wherein the lateral face comprises a top face, a bottom face and two opposite side faces.

7. The masonry wall as claimed in claim 6, wherein the tooth projection of each of said masonry units is projecting from at least one of the top face and side faces.

8. The masonry wall as claimed in claim 7, wherein the tooth projection is a ridge-shaped projection spanning said at least one of the top face and side faces.

9. The masonry wall as claimed in claim 8, wherein the tooth projection is spanning the top face.

10. The masonry wall as claimed in claim 9, wherein the tooth projection is projecting from the back edge of the unit.

11. The masonry wall as claimed in claim 10, comprising a groove extending along the tooth projection.

12. The masonry wall as claimed in claim 11, comprising a series of spaced reinforcing structures along the tooth projection to prevent the tooth projection from being chipped off.

13. The masonry wall as claimed in 12, wherein each of the reinforcing structures has the shape of a sloping projection.

14. A kit for making a masonry wall on a building surface, the kit comprising:

a set of panels to be mounted side by side on the building surface, each one of said panels comprising:

a back face for covering the building surface; and a front face with a plurality of depressions defined and bordered by protruding ribs, said depressions being shaped and sized to receive respective artificial masonry units;

a set of artificial masonry units to be inserted and secured into said depressions, each one of said artificial masonry units comprising:

a body bounded by a front face, a back face, and a lateral face that provides a thickness to the unit, and a back peripheral edge joining the back face and the lateral face, each one of said masonry units further comprising:

a tooth projection projecting from the lateral face next to and parallel to the back peripheral edge so that when each one of said masonry units is inserted into a respective one of said depressions, each one of said tooth projections thrusts into an adjacent protruding rib of a respective one of said depressions and is secured in place; and mortar material for binding the masonry units together.

15. The kit as claimed in claim 14, comprising:

a set of wall-ties for securing the masonry wall to the building surface, each of said wall-ties comprising:

a generally L-shaped bracket to be mounted in a corner of a respective one of said depressions of the panel between the masonry unit inserted therein and the respective depression, said corner being defined by a bottom face and the rib of the depression, said L-shaped bracket comprising:

a) a first flange screwable to the bottom face of the depression and the building surface; and b) a second flange extending at right angle to the first flange along the rib and having an end devised to project out of the depression and to be embedded in the mortar material when a masonry unit is inserted in the depression and mortared.

* * * * *